US006021703A

United States Patent [19]

Geiss et al.

[11] Patent Number: 6,021,703

[45] Date of Patent: Feb. 8, 2000

[54] ARMOR FOR PROTECTION AGAINST SHAPED CHARGE PROJECTILES

[75] Inventors: Klaus Peter Geiss, Egenhofen; Hans Spengler, Aichach, both of Germany

[73] Assignee: DaimlerChrysler Ag, München, Germany

[21] Appl. No.: 07/172,209

[22] Filed: Mar. 16, 1988

[30] Foreign Application Priority Data

Mar. 19, 1987 [DE] Germany ..... 37 08 927

[51] Int. Cl.[7] ..... F41H 5/007; F41H 5/04

[52] U.S. Cl. ..... 89/36.17; 89/36.02

[58] Field of Search ..... 89/36.02, 36.17; 109/36, 37, 49.5

[56] References Cited

U.S. PATENT DOCUMENTS

| | | | |
|---|---|---|---|
| 971,900 | 10/1910 | Klett | 109/36 |
| 1,815,281 | 7/1931 | Ruschmeyer | 109/36 |
| 2,578,556 | 12/1951 | Johnston | 109/37 |
| 3,427,139 | 2/1969 | Gregory | 89/36.17 |
| 3,592,148 | 7/1971 | Manis | 109/37 |
| 4,368,660 | 1/1983 | Held | 89/36.17 |

FOREIGN PATENT DOCUMENTS

| | | | |
|---|---|---|---|
| 2031658 | 5/1972 | Germany | 109/37 |
| 2636595 | 2/1978 | Germany | 89/36.17 |

*Primary Examiner*—Stephen M. Johnson
*Attorney, Agent, or Firm*—McGlew and Tuttle, P.C.

[57] ABSTRACT

An active armor for protection against shaped or hollow charge projectiles (1) is formed by a front and a rear sandwich arrangement (2) and (3). The front sandwich arrangement (2) has a splinter jacket as a front outer layer (5), in order to render the main shaped charge of a twin shaped charge ineffective. The rear sandwich arrangement (3) serves in cooperation with the front sandwich arrangement (2) for rendering single shaped charges ineffective.

4 Claims, 2 Drawing Sheets

Figure 1
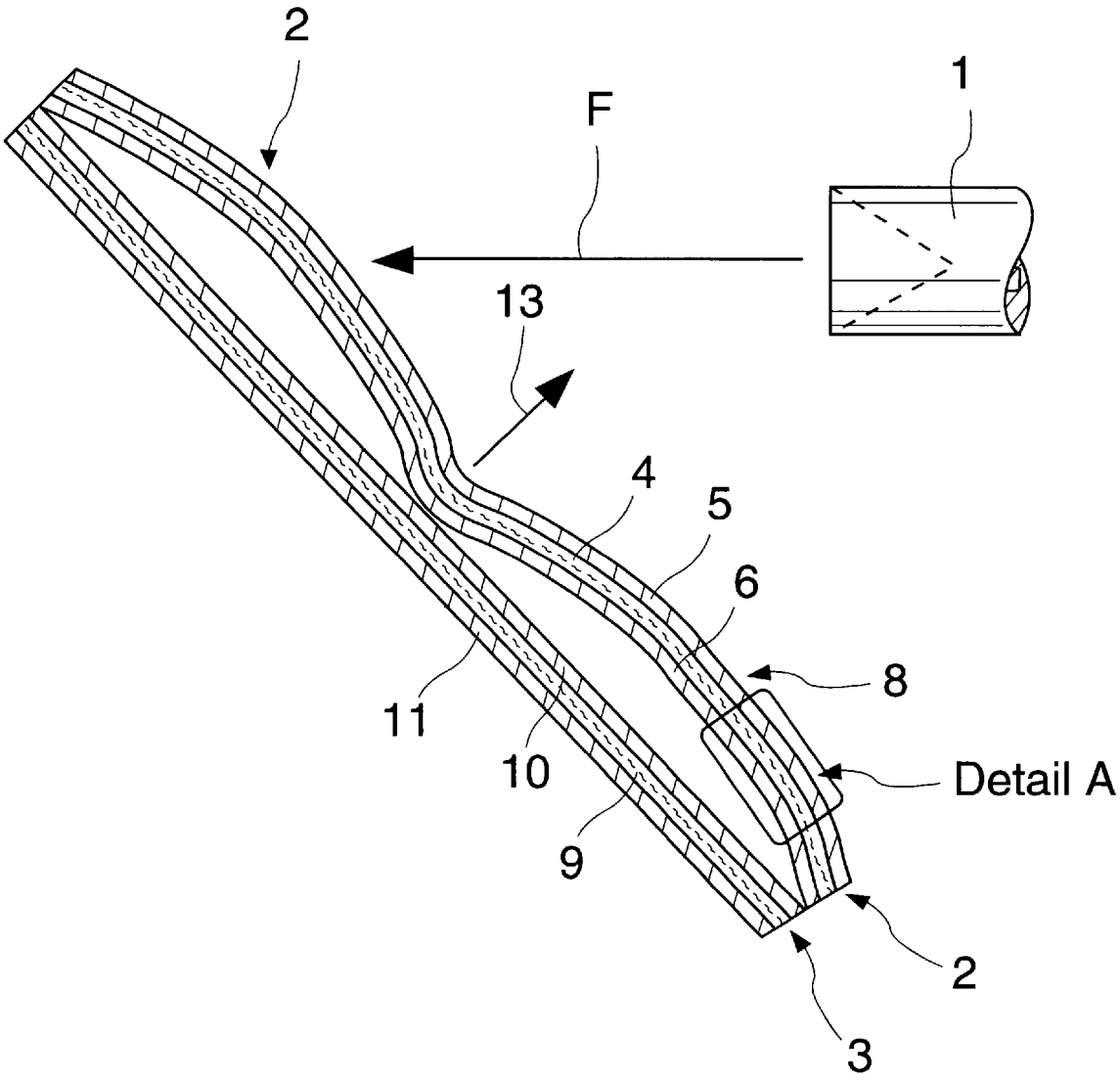
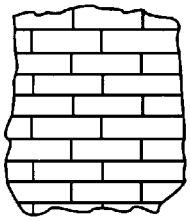
Figure 2

ARMOR FOR PROTECTION AGAINST SHAPED CHARGE PROJECTILES

The invention is directed to armor for protection against shaped or hollow charge projectiles, the armor having a sandwich arrangement including a layer of explosive material, wherein the layer of explosive material is provided with a layer of inert material by way of a barrier on at least its external side facing the incoming projectile.

Armor of this type, also designated as active armor, is discernible from DE-PS 20 08 156. Such armor has been eminently successful in actual practice as armor for battle tanks against monohollow charge projectiles, thus projectiles comprising one single hollow or shaped charge.

The sandwich arrangement with the explosive material layered between two external layers of inert material is herein attached to the tank obliquely to the trajectory of the incoming or impacting projectile. The shaped explosive charge spike sets off the explosive material of the central layer resulting in detonation, wherein the external layers begin to move and, namely, the front layer in the direction of the spike; the front outer layer moves at an angle with respect to the spike because of the oblique position of the armor, so that an intersecting or interface zone is generated at the external layer moving in such a manner, at which zone the spike is consumed or expended.

To render such an active armor ineffective, projectiles with so-called double- or tandem-shaped charges were developed, meaning an initial shaped charge is arranged with axial spacing ahead of the main shaped charge. Herein the initial shaped charge is detonated at a specific distance from the target, so that the spike of the initial charge sets off the explosive material, the external layer being blasted away by the detonation of the explosive material. The spike of the main shaped charge can then penetrate inside the target without interactions with the active armor which would impair the effectiveness of the main shaped charge.

In order to render also the main shaped charge of a twin charge ineffective, it is proposed in patent application P 36 08 959.1 to construct the sandwich arrangement in a convex shape and to fabricate the front external layer of the sandwich arrangement as a jacket consisting of preformed splinters. The main shaped charge is destroyed in this manner before it can form an explosive spike. Such a high scatter of the angle of departure of the splinters is namely achieved by the convex curvature of the sandwich arrangement, that practically all trajectories of the shaped charge projectile are covered.

Tests have demonstrated that the protection of the active armor according to this patent application is indeed excellent when faced with twin shaped charges, however, it leaves something to be desired when protection against monoshaped charges is involved. The explosive spike of the monoshaped charge is namely, generally richer in mass than the spike of an initial shaped charge, which is resisted by this active armor.

There are limits however to a more sturdy design of the active armor in accordance with this patent publication in order to also dissipate the residual energy of the spike of a monoshaped charge; this namely because with a sturdy design, the rear outer layer strikes the target, thus, for instance, the main armor of a tank, with a greater momentum when the active armor is detonated, so that the target must also be designed in a more sturdy manner.

It is therefore the task of the invention to indicate an active armor providing a high degree of protection against mono as well as against twin shaped charges.

Thus, the armor in the invention consists of two sandwich arrangements. The sandwich arrangement which is first along the trajectory of the shaped charge projectile,being cambered towards the front therefore in the direction of the incoming projectile and whose outer layer consists of a frangible material or of preformed splinters, herein renders the twin shaped charge ineffective. On the other hand, the front sandwich arrangement only partially reduces the power of the spike of a mono shaped charge. The residual power of the spike of a mono or single shaped charge is absorbed by the sandwich arrangement arranged behind the front sandwich. The mass of the rear sandwich arrangement is designed to correspond to the power of the spike of the mono shaped charge which remains after said charge has penetrated the front sandwich arrangement.

Furthermore, the rear outer layer of the front sandwich arrangement and the front outer layer of the rear sandwich arrangement located opposite each other strike each other upon detonation of the explosive material of both sandwich arrangements in the armor constructed according to the invention. This entails on the one hand that the target thus, for instance, the main armor of the tank which is equipped with the armor according to the invention, is required only to resist the pressure of the explosive material layer or the rear outer layer of the rear sandwich arrangement, while the pressure of the rear outer layer of the front sandwich arrangement is at least partially compensated by the opposite movement direction of the front outer layer of the rear sandwich arrangement.

In order to obtain complete compensation, the masses or the explosive materials of the rear outer layer of the front sandwich arrangement and the front outer layer of the rear sandwich arrangement are designed in such a way that the impulse or momentum of the front outer layer of the rear sandwich arrangement is greater than that of the rear outer layer of the front sandwich arrangement when the two outer layers collide; preferably however not very much greater, so that after the collision the layer formed from both outer layers which consumes the spike of the mono shaped charge has a relatively low velocity, so that it remains as long as possible in the target region of the shaped charge spike.

The active armor of the invention can be easily used as a retrofittable kit for armored vehicles; in any case, in those main armors which are able to resist a conventional active armor.

The rear sandwich arrangement is preferably inclined with respect to the trajectory of the incoming projectile, so that the front outer layer of the rear sandwich arrangement moves obliquely to the spike of the shaped charge after detonation of the active armor, so that a zone of intersection or an interface is formed at the layer consisting of this outer layer as well as the rear outer layer of the front sandwich arrangement, at which zone of intersection, the shaped charge spike of a mono shaped charge which is rich in mass is also consumed.

The front sandwich arrangement is herein preferably appropriately inclined so that both sandwich arrangements contact each other at their sides.

In order to be able to utilize the armor in the invention also against other configurations of shaped or hollow charges, it is advantageous to provide a multiple camber for the front sandwich arrangement. With such a multiple camber, the armor in the invention is namely also effective against such twin shaped charges in which a projectile forming charge instead of the front shaped charge is provided.

Such a projectile forming the initial charge tears namely a relatively large hole in the front sandwich arrangement, so that, in that case, possibly no splinters from the splinter forming outer layer impact any more upon the main shaped charge or the twin shaped charge, in order to render same ineffective. In this case, the adjacent curvature of the front sandwich arrangement is effective, meaning its splinters strike the main shaped charge and, thus, render same ineffective.

The advantages of the armor according to the invention are thus to be seen in an increased protection against mono shaped charges and twin shaped charges. Its effectiveness is relatively independent of the angle of attack. Apart from a relatively economical fabrication, the material savings in the main armor of the target is a contributory advantage.

The effectiveness of the armor in the invention consists herein essentially in that with twin charges, the shaped charge spike of the initial charge sets off the explosive material of the middle layer of the front sandwich arrangement, whereupon the splinters formed from the front outer layer of the front sandwich arrangement are shot to meet the main charge at defined angles of departure corresponding to the radius of curvature of the camber of the front sandwich arrangement. The main charge is thus destroyed without being able to form a spike.

The rear outer layer of the front sandwich arrangement is blasted rearwards and unites with the front outer layer of the rear sandwich arrangement which is being propelled forward. The result is a relatively thick layer of inert material which can be optimized in design and which lifts itself off slowly towards the front, which layer of inert material continuously consumes the incoming shaped charge spike of a mono shaped charge. The penetrating spike particles are then also interfered with in case of a rear sandwich arrangement with a rear outer layer in the course of its being propelled rearwards, so that a penetration depth of the spike into the main armor is no longer possible.

FIG. 1 is illustrative of a cross-section of the bulge active armor configuration.

FIG. 2 is illustrative of a portion of the Detail A section of FIG. 1.

Figure 3:
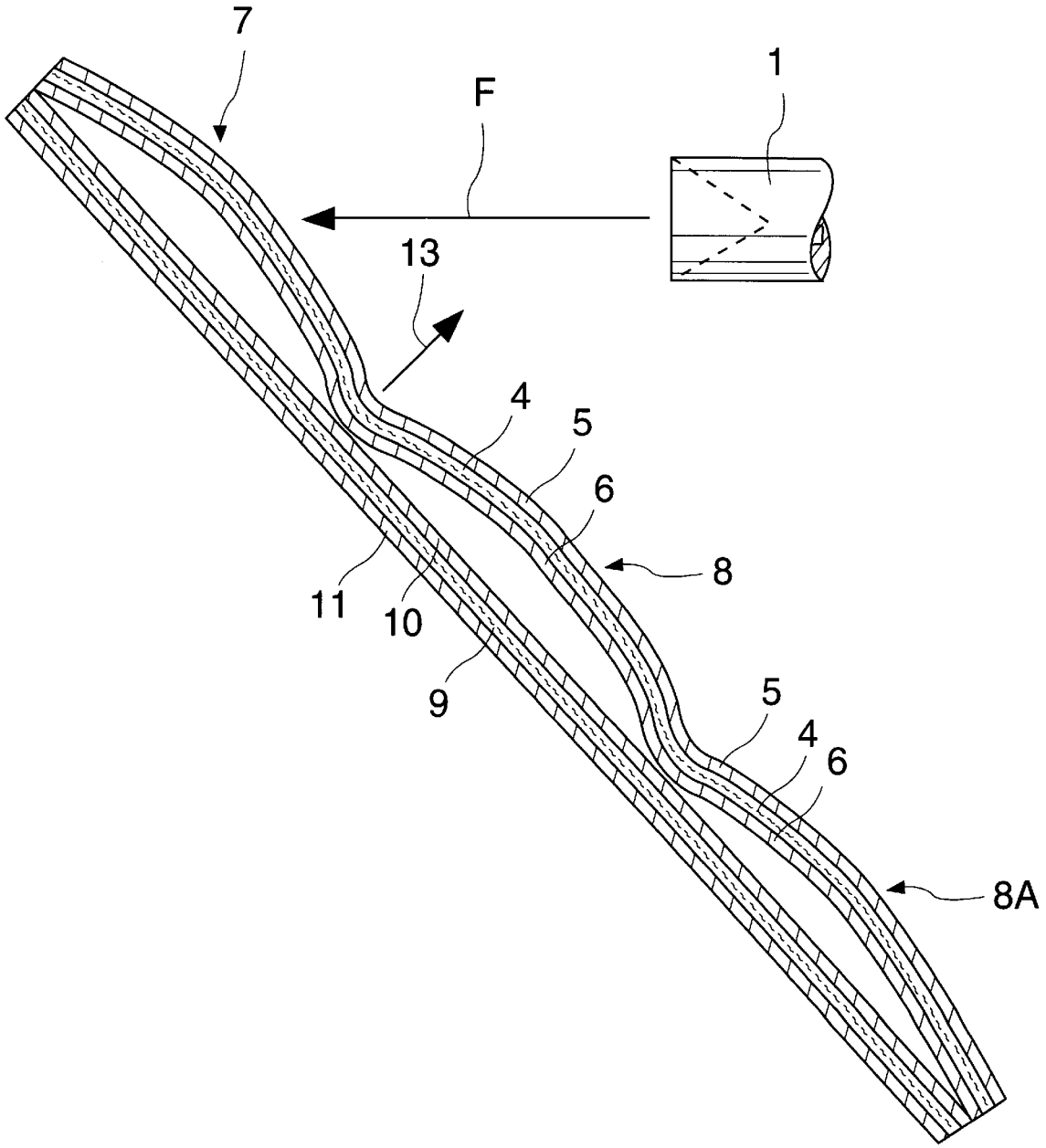
FIG. 3 is illustrative of a cross-section of the three bulge active armor configuration.

The armor consists accordingly of a front sandwich arrangement 2 viewed in the direction of trajectory F of the shaped charge projectile or missile 1 and a rear sandwich arrangement 3 arranged behind said front sandwich arrangement, behind which the target is located, thus, for instance, the main armor of a combat vehicle. The front sandwich arrangement 2 consists of a middle layer 4 of explosive material and two outer layers 5 and 6 on both sides of the middle layer 4.

The front outer layer 5 of the front sandwich arrangement 2 is herein designed as a splinter jacket which, for instance, consists of preformed splinters. The rear outer layer 6 of the front sandwich arrangement 2 consists of resistant inert material.

The front sandwich arrangement 2 is furthermore provided with two convex bulges or salients 7 and 8 which are thus curved counter to the trajectory direction F of the shaped charge projectile 1. It is achieved by the bulges 7 and 8 that splinters from the outer layer 5 of the front sandwich arrangement 2 are generated in practically all trajectory directions of the shaped charge projectile 1 against the active armor, which splinters render the main shaped charge ineffective in twin shaped charge projectiles.

The two bulges 7 and 8 have the advantage compared to one single bulge, that the active armor is effective also against such twin charges in which the initial charge is a projectile forming charge and the main charge is a shaped or hollow charge. Then, namely a large hole is torn indeed by the projectile into the bulge 7 of the sandwich arrangement 2, so that possibly splinters are no longer formed which strike the shaped charge of the twin charge. However, the adjacent bulge 8 of the outer layer 5 forms splinters which depart in the direction of the shaped charge and render same ineffective.

The rear sandwich arrangement 3 consists of a middle layer 9 from explosive material and two outer layers 10 and 11 on both sides of the middle layer 9.

The rear sandwich arrangement 3 of the element is designed to be flat and is connected at its ends with the ends of the front sandwich arrangement 2. For the rest of it, a spacing between the rear sandwich arrangement 3 and the front sandwich arrangement 2 is provided and, of course, also in the region of the front sandwich arrangement 2 between the two bulges 7 and 8.

The rear sandwich arrangement 3 and the front sandwich arrangement 2 are arranged at an angle to the trajectory F of the incoming shaped charge projectile 1. If the projectile 1 consists of a single shaped charge, the rear outer layer 6 of the front sandwich arrangement 2 is blasted rearwards after the explosive layers 4 and 9 have been set off by the shaped charge spike, wherein the outer layer unites with the outer layer 10 of the rear sandwich arrangement 3 which is flying forward to form a thick plate which lifts itself off slowly towards the front, the plate moving in the direction of the normal line 13, thus obliquely to the trajectory F of the shaped charge projectile 1 and, thus, of the shaped charge spike so that a zone of intersection or an interface is generated at the thus moving plate at which the spike is consumed.

The inert material of the outer layers 10 and 11 of the rear sandwich arrangement 3 and the rear outer layer 6 of the front sandwich arrangement 2 is preferably a metal, especially steel, or another material of high density. The thickness of the layers of the outer layers 6, 10 and 11 can herein amount to 0.5 to 5 mm. The explosive material of the middle layers 4 and 9 of both sandwich arrangements 2 and 3 can be a foil of explosive material with a thickness of 0.5 to 5 mm. The splinter forming outer layer 5 of the front sandwich arrangement 2 is designed in such a way that it generates as large a quantity of splinters as possible which penetrate into the attacking main shaped charge.

We claim:

1. Armor for protection against shaped projectiles having a trajectory direction toward said armor, said armor comprising a first plate section and a second plate section located in front of said first plate section opposite to the trajectory direction of the projectile toward said armor so that the projectile strikes first against the second plate section, said first plate section being planar and disposed at an oblique angle to the trajectory direction of the projectile, said second plate section having an undulating configuration with a variable spacing from said first plate section, said second plate section comprising at least three undulating layers including a first layer more remote from said first plate section than a second layer, said first layer comprises a splinter layer made up of preformed splinters, a third layer located between said second layer and said first plate section, said second layer comprises an explosive material, said third layer comprises an inert material, said first plate section comprises at least two planar layers including a first layer closer to said second plate section than a second layer, said first layer of said first plate section comprises an inert material and said second layer of said first plate section comprises an explosive material, said first and second plate sections having bounding ends with said bounding ends of said first and second plate sections being connected together and said second plate section being curved convexly outwardly from said first plate section and having at least two convexly outwardly directed bulges between said connecting ends relative to said first plate section with each said bulges first curving outwardly from one of the connected ends and then curving inwardly toward said first plate section.

2. Armor, as set forth in claim 1, wherein said bulges at inwardly curved portions thereof remote from the connected ends being in spaced relation relative to said first plate section.

3. Armor, as set forth in claim 1, wherein the mass of the second and third layers of said second plate section and the mass of the first and second layers of said first plate section being arranged so that upon detonation of the explosive material within said first and second plate sections the impetus of said first layer of said first plate section is at least as great as the impetus of the third layer of said second plate section when said first layer of said first plate section and said third layer of said second plate section impact one another.

4. Armor, as set forth in claim 1, wherein said second plate section comprises at least three said bulges.

* * * * *